United States Patent [19]

Waddoup et al.

[11] Patent Number: 4,672,387

[45] Date of Patent: Jun. 9, 1987

[54] ANTENNA SYSTEMS FOR OMNIDIRECTIONAL PATTERN

[75] Inventors: William D. Waddoup, Harlow; Andrew P. Norris, Dunmow, both of England

[73] Assignee: International Standard Electric Corporation, New York, N.Y.

[21] Appl. No.: 707,626

[22] Filed: Mar. 4, 1985

[51] Int. Cl.[4] ..... H01Q 19/13

[52] U.S. Cl. ..... 343/781 P; 343/840

[58] Field of Search ..... 343/781 R, 781 P, 781 CA, 343/837

[56] References Cited

U.S. PATENT DOCUMENTS

| | | | |
|---|---|---|---|
| 2,549,143 | 4/1951 | Tinus | 343/781 P |
| 2,645,769 | 7/1953 | Roberts | 343/781 P |
| 3,787,869 | 1/1974 | Charlton et al. | 343/781 P |

FOREIGN PATENT DOCUMENTS

| | | | |
|---|---|---|---|
| 1616252 | 2/1968 | Fed. Rep. of Germany | 343/781 R |
| 2334216 | 1/1977 | France | 343/781 R |

*Primary Examiner*—Eli Lieberman

*Attorney, Agent, or Firm*—T. L. Peterson; J. M. May

[57] ABSTRACT

An antenna system which has omnidirectional coverage in azimuth and sectoral coverage in elevation. A main reflector including a reflecting surface has polar symmetry about the Z-axis. It also has a cross section in any plane containing the Z-axis which satisfies the laws of power conservation and reflection. It is determined by the desired far-field pattern and the microwave feed pattern (for example $TM_{01}$) employed. Single or dual reflector systems are described. Using the system on "receive" with multiple "feeds", full azimuthal direction finding of incident radiation can be achieved.

3 Claims, 25 Drawing Figures

Fig.5b.
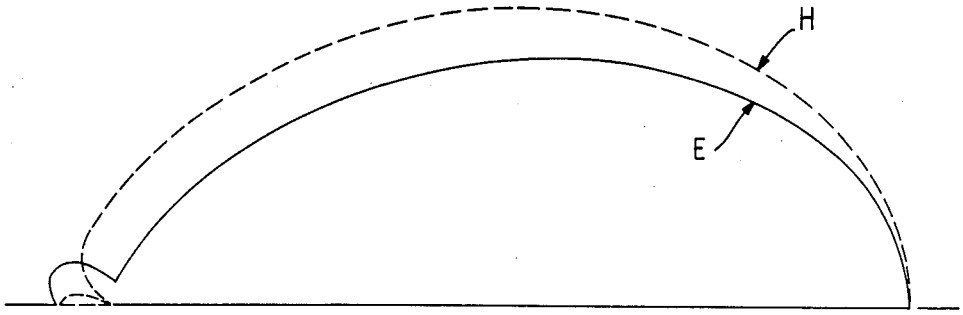
Fig.6a.
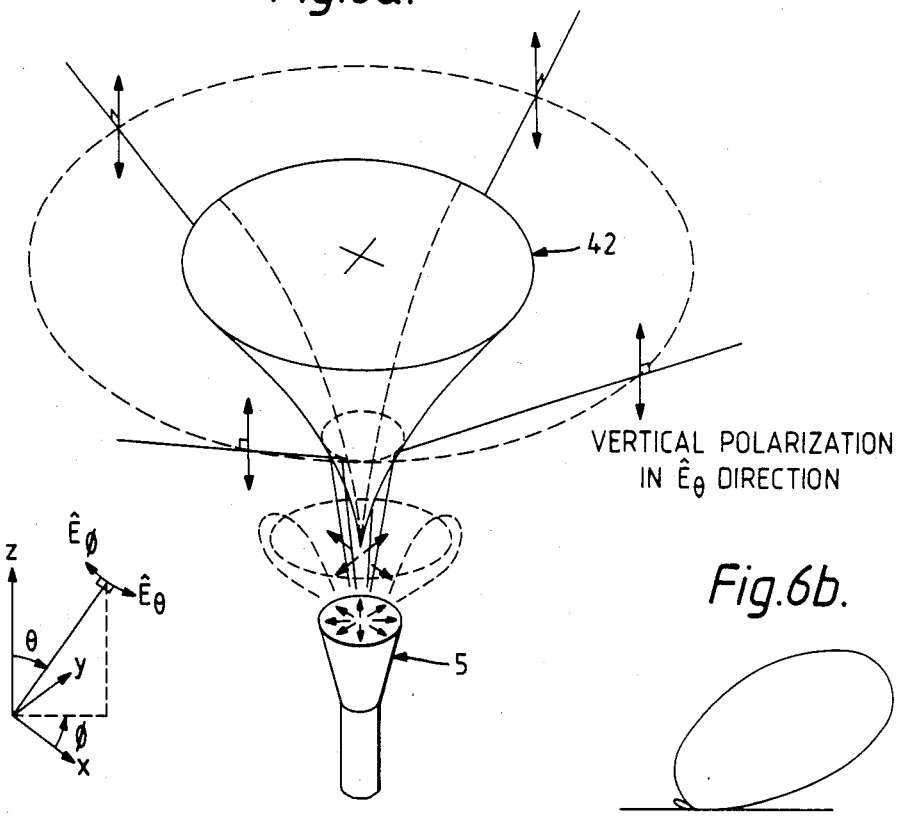
Fig.6b.

+ THEORETICAL VALUES
— MEASURED PATTERN

ANTENNA SYSTEMS FOR OMNIDIRECTIONAL PATTERN

BACKGROUND OF THE INVENTION

This invention relates to antenna systems, and more particularly to millimeter wave antenna systems.

SUMMARY OF THE INVENTION

According to the present invention there is provided an antenna system including a main reflector which is symmetrical about a first axis and has a reflecting surface shaped such that when radiowave energy is directed thereat from feed means on the first axis it can be reflected azimuthally omnidirectionally therefrom in such a manner as to obtain a far-field pattern with a predetermined sectoral elevation.

BRIEF DESCRIPTION OF THE DRAWINGS

Embodiments of the invention will now be described with reference to the accompanying drawings, in which:

FIG. 5*b* is a graph of a $TE_{11}$ linearly polarized feed horn pattern which is slightly asymmetric about the Z-axis;

FIG. 6*a* is a perspective view of a (TB) reflector with a radially polarized feed horn ($TM_{01}$ mode) and showing constant vertical polarization with azimuth ($\phi$) in the far field;

FIG. 6*b* is a graph of a $TM_{01}$ mode feed pattern which is symmetrical about the Z-axis;

DESCRIPTION OF THE PREFERRED EMBODIMENTS

Figure 1:
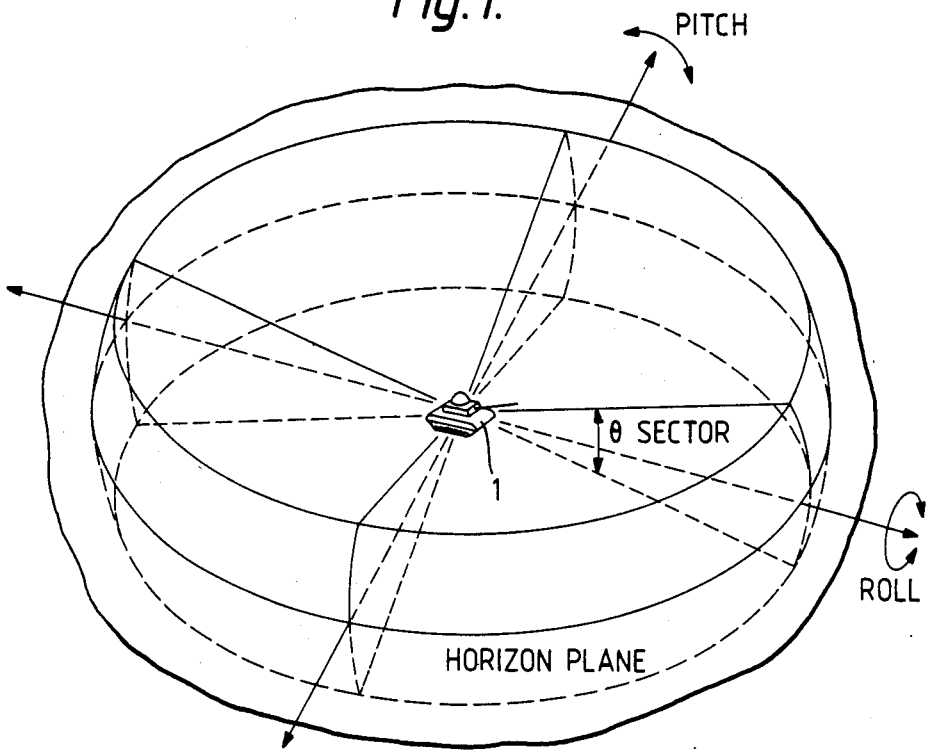
FIG. 1 is a diagrammatic view of the coverage of an azimuthally omnidirectional antenna with sectoral elevation.

A requirement for surface-to-surface communication between vehicles, sea-going ships or low-flying aircraft is an antenna system having omnidirectional coverage in azimuth, and sectoral coverage in elevation distributed about the horizon. This will enable nearly constant transmission and reception at nearly any azimuth when the pitch and roll of the platform on which the antenna system is mounted is not unreasonable. The overall coverage of such an antenna as mounted on a tank 1, for example, is illustrated in FIG. 1. The pitch direction and the roll direction are shown in FIG. 1.

The gain of such an antenna over a true omnidirectional coverage is purely due to the restricted elevation coverage from $(\pi-\Theta_{sector})//2$ to $(\pi+_{sector})//2$ for the sectoral antenna. This is as opposed to the full elevation coverage, from 0 to $\pi$, for a true isotropic omnidirectional antenna. Integration over the elevation element of solid angle $\sin\Theta d\Theta$ gives the gain (G) of the sectoral antenna with respect to the isotropic antenna as $$G=10\log_{10}[\sin(\Theta_{sector}/2]^{-1}$$

For a sector angle of $\pi/3$ ($\pm\pi/6$ with respect to the horizon) which might be typical of platform pitch and roll $$G=10\log_{10}[^1/2]^{-1}=10\log_{10}2\cong 3\text{ dB}.$$

At microwave frequencies, the cost of providing such an antenna outweighs the cost of providing the relatively modest increase in 1-way transmission power of 3 dB necessary if a simple truly omnidirectional antenna were to be employed. In addition the physical size of the antenna may be inconvenient.

At millimeter wavelengths, however, transmitter power is more costly and may, in any case, be limited by physical considerations. The size of the antenna is scaled down proportionately with wavelength. Thus, at millimeter wavelengths such an antenna becomes particularly attractive. For example, the same is attractive for communication systems or when incorporating azimuthal direction-finding for an electronic surveillance receiver and for radar purposes.

Figure 2A:
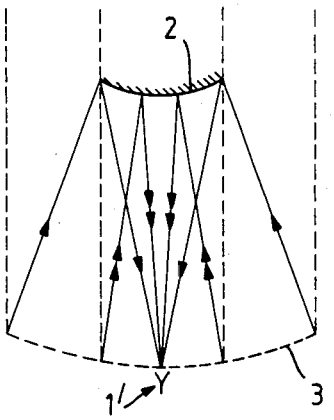
FIGS. 2*a* and 2*b* are diagrammatic views of a section and a view, respectively, of a conventional Cassegrain antenna system.
Figure 2B:
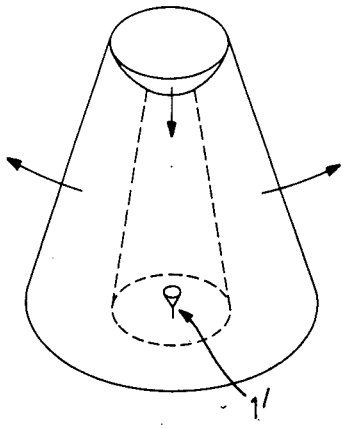

The basic concept of the antenna design of the present invention is derived from the feed and reflector of a Cassegrain antenna system, such as shown in FIGS. 2*a* and 2*b*. A feed 1' is disposed at the focus of a sub-reflector 2, there being a main reflector 3. The function of the sub-reflector 2 is to collect feed energy to provide azimuthally symmetric radiation to the main reflector 3 covering the elevation range $\Theta_{edge}$ to $\pi/2$.

Considering now the feed and sub-reflector alone; if the sub-reflector shape is progressively deepened, the elevation angles of its coverage patterns will correspondingly decrease while the azimuthal pattern will remain isotropic. Thus a desired distribution of elevation angle of the coverage pattern about the horizon can be achieved.

Figure 3:
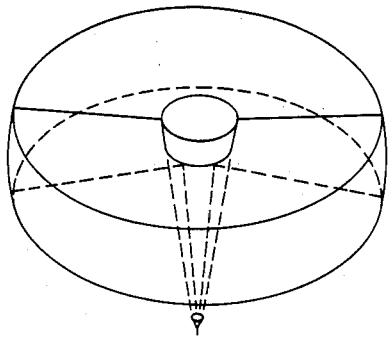
FIG. 3 is a perspective view of one reflector for sectoral elevation.
Figure 4:
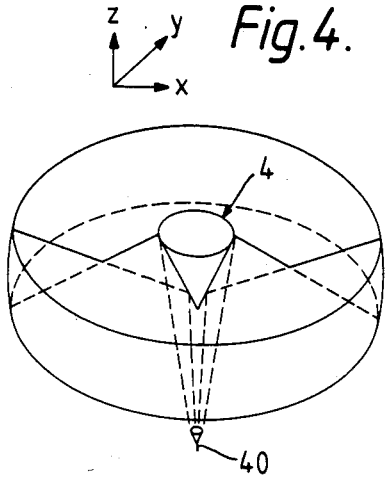
FIG. 4 is a perspective view of another reflector shape for sectoral elevation.

Two possible basic forms of the reflector shape both having identical geometric optics radiation patterns are indicated in FIGS. 3 and 4. FIG. 4 shows a TB (top-to-bottom) solution, so called because the top ray from the feed is associated with the bottom ray in the far-field, and vice-versa. FIG. 3 shows a TT (top-to-top) solution.

The reflecting surface 4 (FIG. 4) has a radially outer surface of an element which tapers generally in the direction of the Z axis towards a feed 40 which is spaced apart from the apex of the tapering element.

The azimuthally omnidirectional coverage requirement means that the reflector is symmetrical about the Z-axis. This eases the construction of the reflector shape and makes production a cost-effective proposition. The cross-sectional shape of the reflector in any plane containing the Z-axis must satisfy the laws of reflection and power conservation and is determined by the desired far-field pattern and the feed pattern employed.

With synthesis of the reflector shape based upon the principles of geometric optics, the vertical height of the antenna (the dimension presented to incident radiation in the elevation domain) must be greater than about $10\lambda$ if the actual pattern is to be a reasonable approximation to that given by geometric optics.

Figure 5A:
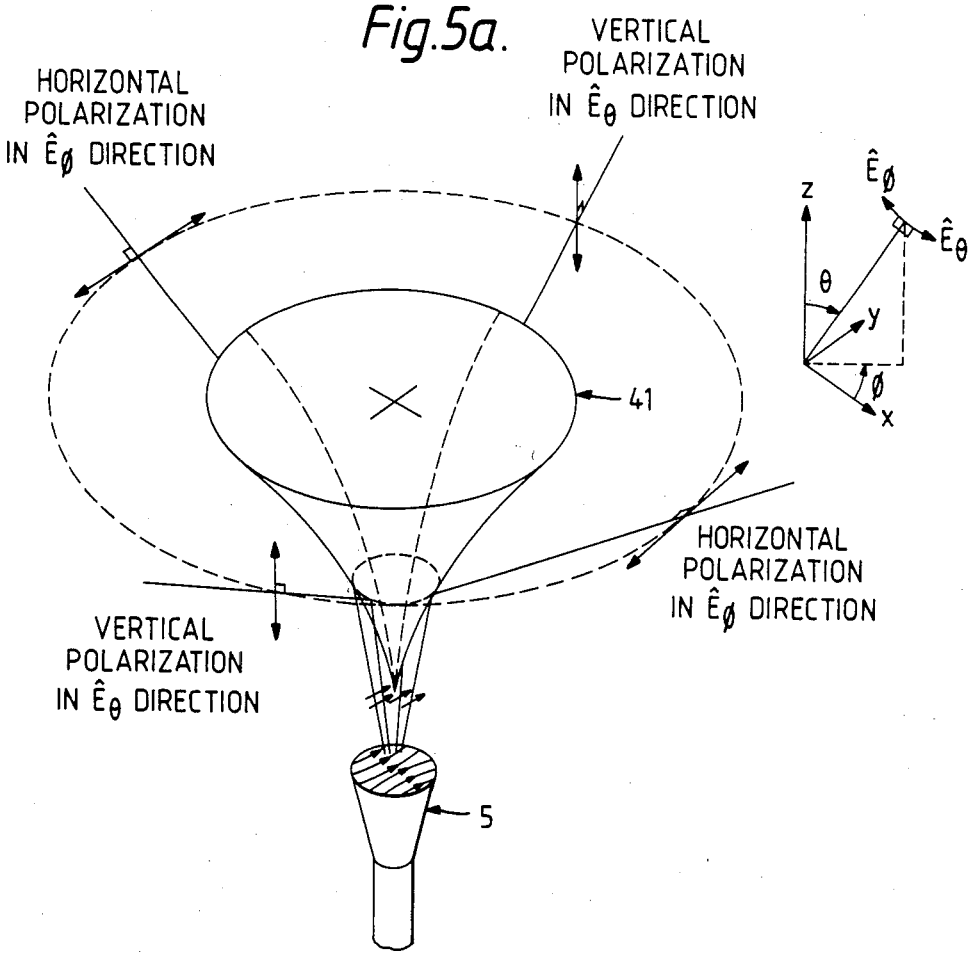
FIG. 5*a* is a perspective view of a reflector with a linearly polarized feed horn and showing the far-field plane of polarization rotating with azimuth ($\phi$)

An antenna system comprises both a feed and its particular associated reflector, and the type of feed to be employed is an integral part of the reflector design. The desirable property, mentioned above, of the azimuthal symmetry of the reflector is also dependent on the feed pattern being azimuthally omnidirectional. A further important consideration is the polarization properties of the feed. The use of a circular feed aperture with three types of fields is discussed below. If, as illustrated in FIG. 5*a*, a reflector 41 is fed by a linearly polarized feed, such as an open-ended circular waveguide or circular horn 5 excited in the $TE_{11}$ mode, there results linearly polarized far-field radiation whose plane of polarization rotates with changing azimuth. This is likely to be undesirable in a system for communications use. A typical plot of a computed elevation for such a feed is shown in FIG. 5*b* for $ka=3.588$, where a is the waveguide radius at the final feed aperture and $k=2\pi/\lambda$. The elevation patterns differ slightly in the H and E planes. That is, the feed pattern is not truly azimuthally symmetric. In the case of a circularly polarized feed such as the $TE_{11}$ feed described above but in conjunction with an orthomode transducer, constant circular polarization is produced in the far-field of the reflector at all azimuth angles. A particularly attractive feed for the reflector shape proposed is an open-ended circular waveguide or horn in the $TM_{01}$ mode. All of the E-vectors are radial (radially polarized feed) and the patterns are truly azimuthally symmetrical. Such an arrangement is shown in FIG. 6*a*. Two beneficial consequences of this arrangement are that the far-field radiation from the reflector is vertically polarized over all azimuths and that there is a null on the feed boresight. The latter is convenient because it greatly reduces the illumination of the tip of the reflector 42 and hence reduces possible diffraction from that point which could affect the desired far-field patterns. A computed elevation pattern for a typical value of $ka=3.873$ for a $TM_{01}$ open-ended circular waveguide feed is shown in FIG. 6*b*. It indicates that this feed pattern is azimuthally symmetric.

Figure 7A:
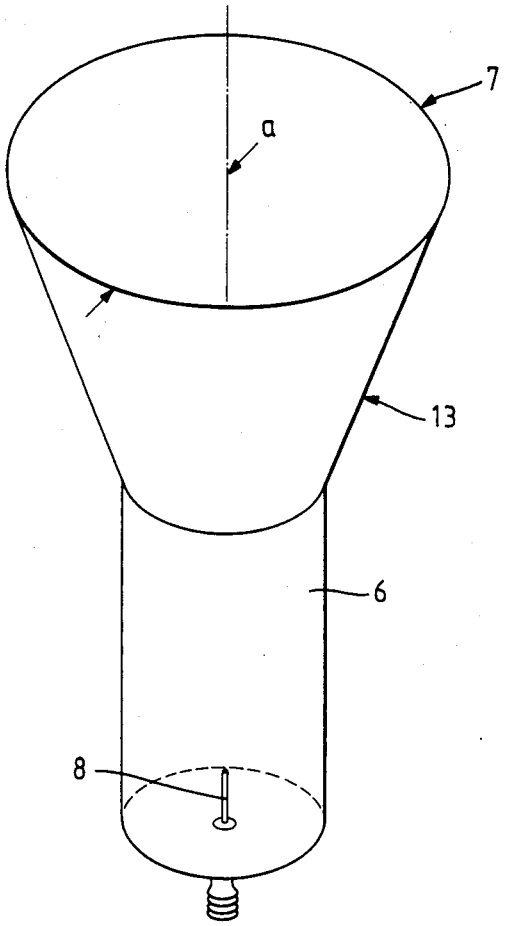
FIG. 7*a* is a perspective view of a waveguide feed ($TM_{01}$ mode)
Figure 7B:
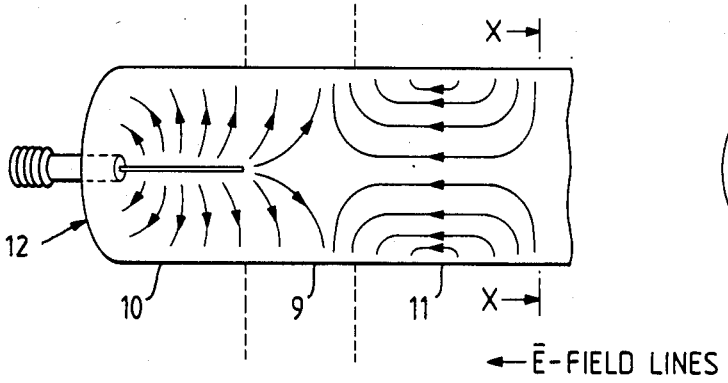
FIGS. 7*b* and 7*c* are diagrammatic views illustrating the field patterns in the feed of FIG. 7*a;*
Figure 7C:
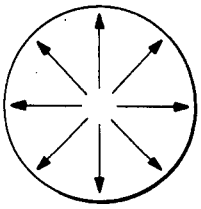

FIGS. 7*a*, 7*b* and 7*c* illustrate a radially polarized $TM_{01}$ feed ($ka=5.50$) for X-band. The diameter of a cylindrical section 6 is 30 mm the diameter (2*a*) of the final feed aperture 7 is 59.5 mm and the launching stub 8 is 8.5 mm long. The lowest order modes are the $TE_{11}$ mode (fundamental) and the $TM_{01}$ mode. In order to cut off modes higher than $TE_{11}$ and $TM_{01}$ the diameter of section 6 equals $\pi/1.133$ so that it is 10% below the cut-off frequency for the next mode ($TE_{21}$) To ensure that the $TM_{01}$ mode is excited in preference to the $TE_{11}$ mode, the radial symmetry of the $TM_{01}$ mode is mirrored by that of the launcher used. The launching stub 8 is $\lambda/4$ long so that backward traveling waves, originating in the vicinity of the transition region 9 between the coaxial section 10 and the $TM_{01}$ region 11, are cancelled upon reflection from the rear end 12. The length of the cylindrical section 6 from the transition region 9 to the beginning of the flared section 13 ($TM_{01}$ region 11) is such as to permit pure $TM_{01}$ mode excitation to be achieved. The waveguide diameter is gradually increased over the flared section 13 in order to maintain mode purity and to provide the final feed aperture necessary to produce relatively narrow feed beamwidths.

Figure 8B:
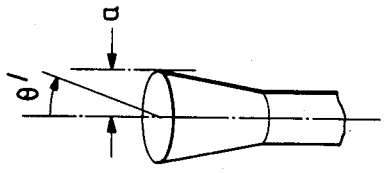
FIG. 8*b* is a diagrammatic view illustrating $\Theta^1$.
Figure 8A:
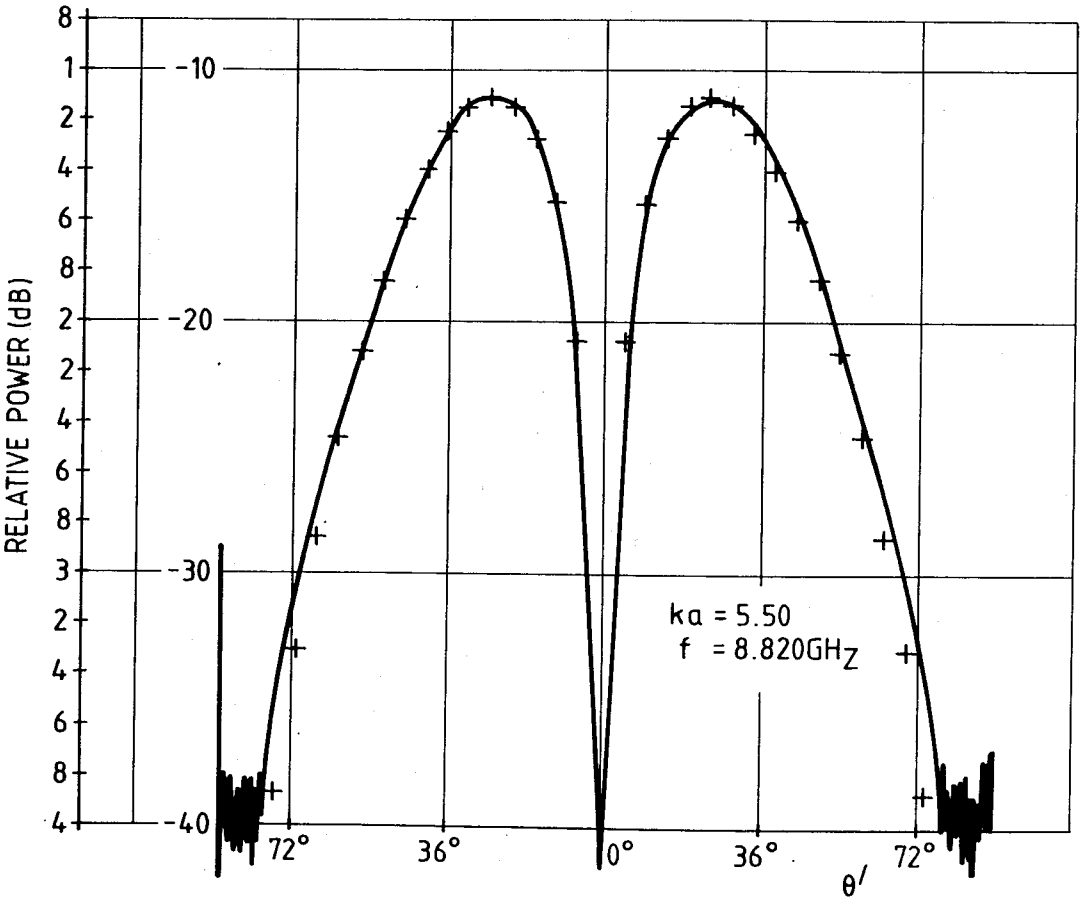
FIG. 8*a* is a graph of computed and measured values for relative power versus $\Theta^1$ for a $TM_{01}$ mode feed.

Measurement of relative power (dB) against $\Theta^1$ (FIG. 8*b*) have been made for $ka=5.50$ and the measured pattern is compared with theoretical computed values in FIG. 8*a*. The goodness of fit and the depth of the boresight null are considered good indications of the purity of the excitation of the $TM_{01}$ mode as opposed to $TE_{11}$. This type of transmission is rather narrow band, but its simplicity is ideally suited for demonstration model purposes. More complex but broadband transmissions are available.

The profile of reflector 42 in FIG. 6*a* (single-reflector antenna design) for two types of an azimuthally symmetrical feed have been synthesized using geometric optics. The synthesis was checked by a physical optics analysis of the far-field patterns of the resulting profiles with their associated feeds and by observing the deviations of these patterns from the ideal sectoral requirement.

The mainbeam copolar power pattern of a conical feed horn excited in the $TE_{11}$ mode can be represented by $P=\cos^q A\Theta^1$. A value of $q=1.5$ was chosen and $A=1.724$ was determined as the value required to produce $-10$ dB illumination at the reflector edge where $\Theta^1=45°$. The far-field was required to be of constant power over the elevation range $60° \leqq \Theta \leqq 120°$ and zero elsewhere.

Figure 9:
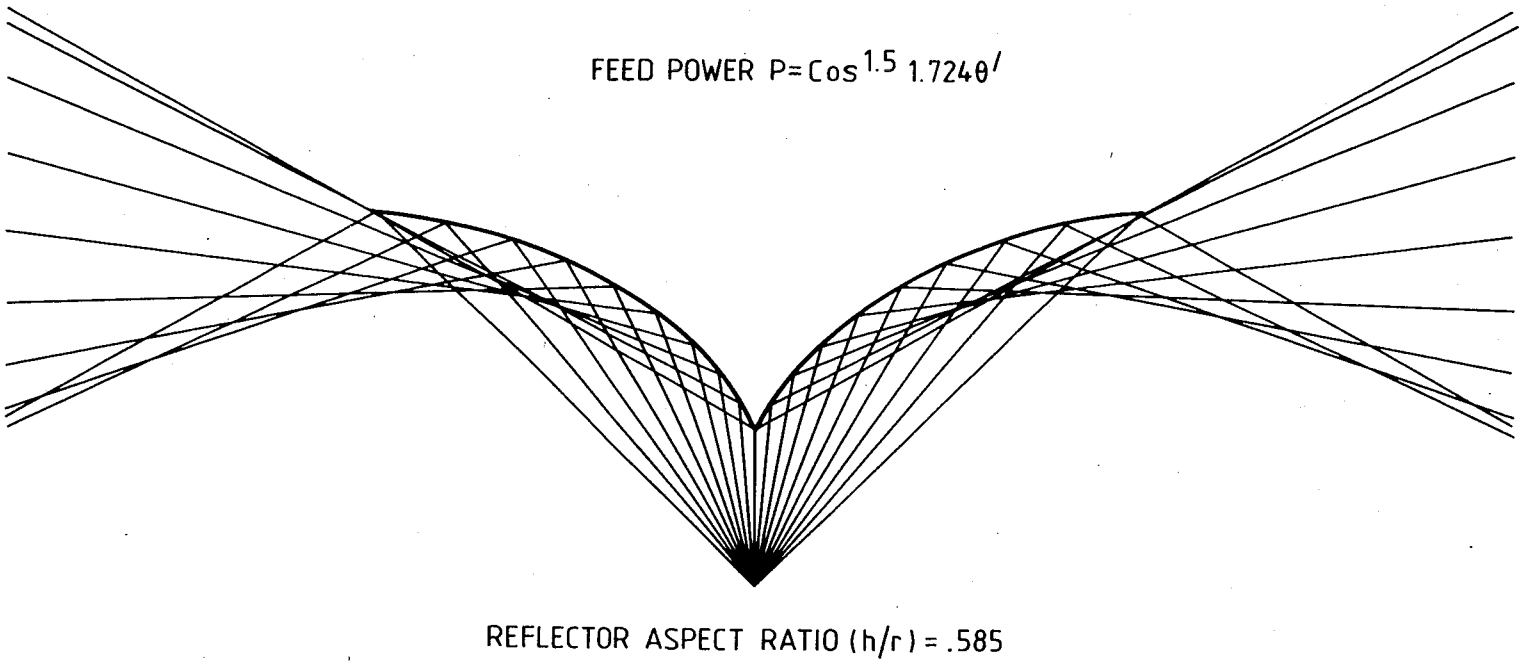
FIG. 9 is a diagrammatic view of a main beam copolar power pattern for a conical feed horn with a feed pattern of the form $\cos^q(A\Theta^1)$, with a reflector of one cross-sectional shape.

The result of this first synthesis is shown in FIG. 9 which is a cross-sectional cut through the reflector with representative ray geometries. The reflector aspect ratio (h/r) is very low (0.585) making it bulky and difficult to manufacture. In addition, the linear polarization of the feed leads to the drawback of a rotating plane of polarization in the far-field of the reflector as mentioned above.

Figure 10A:
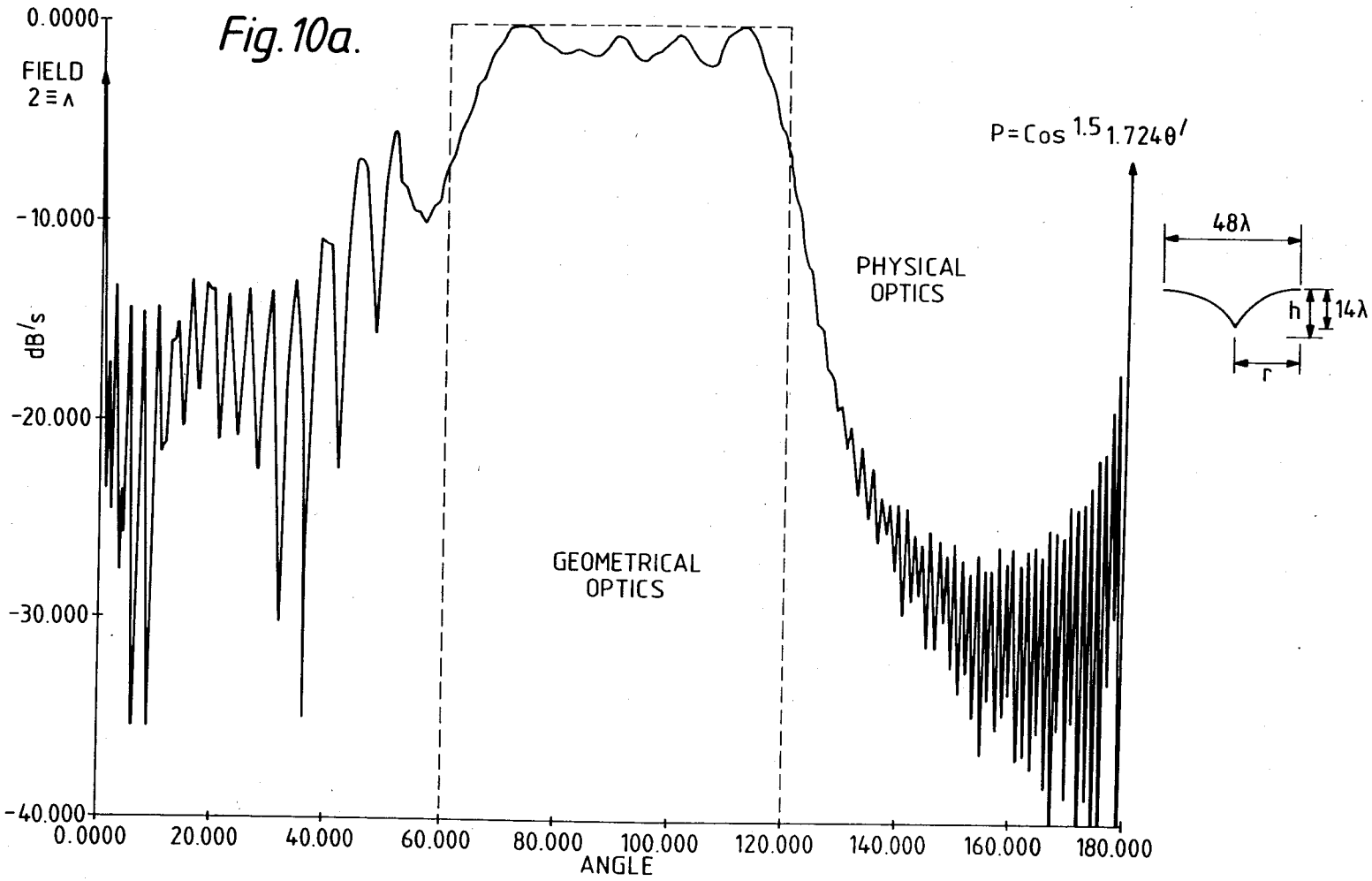
FIGS. 10*a* and 10*b* are graphs illustrating far-field elevation patterns as given by physical optics (solid line) and geometric optics (dashed line) for an antenna height $h=14\lambda$ and $h=140\lambda$ respectively, for a single reflector.
Figure 10B:
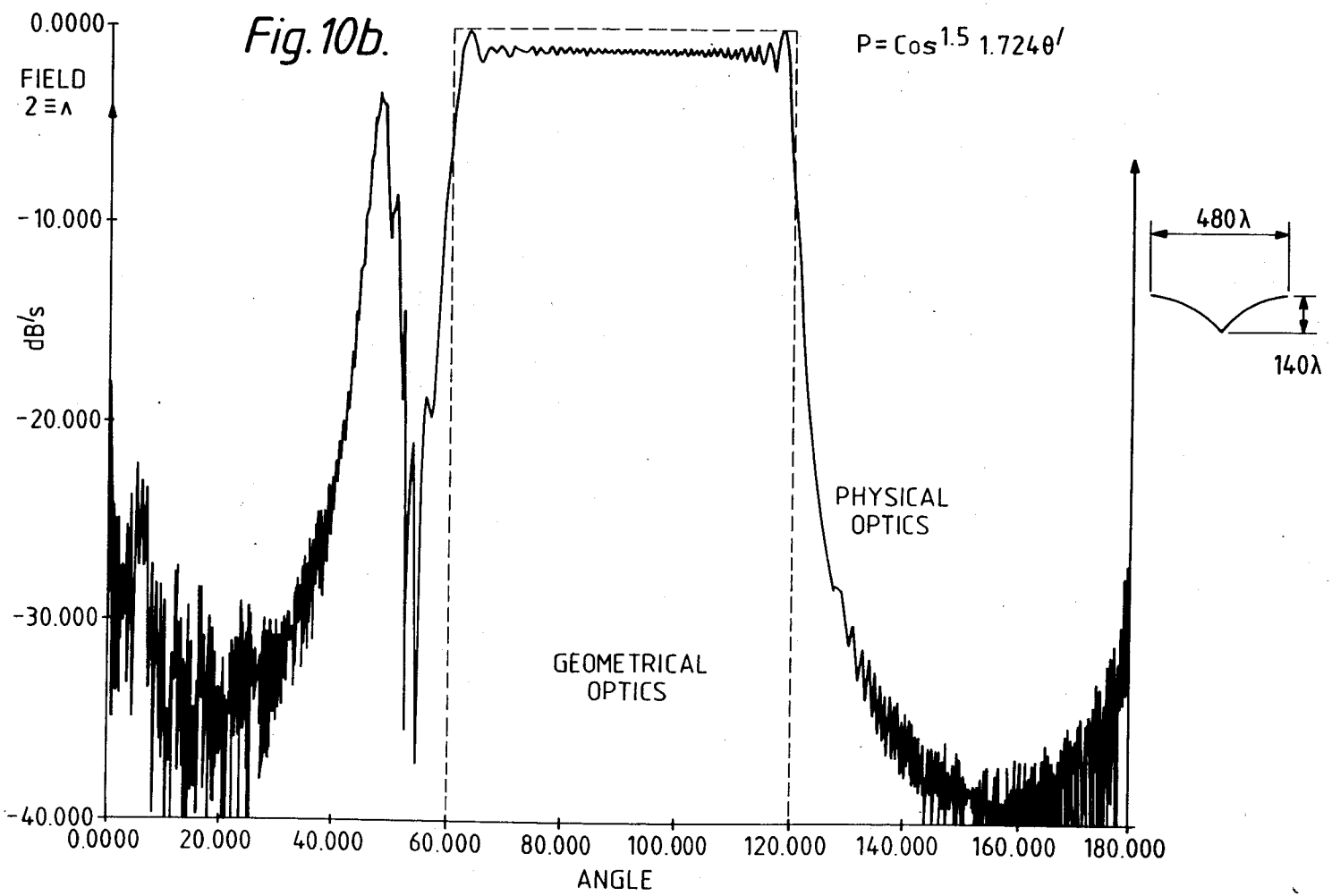

The far-field elevation patterns derived using a physical optics analysis of the reflector profile and reflectors of different heights are shown in FIGS. 10*a* and 10*b*. FIG. 10*a* shows the far-field elevation pattern for $h=14\lambda$. The main feature of the sectoral pattern ($\Theta=60°$ to $120°$) and the spillover in the region around $\Theta=45°$ are clearly identifiable. FIG. 10*b* shows the far-field elevation pattern for $h=140\lambda$. The sectoral region follows the geometric optics ideal (dashed-line) much more closely, as would be expected, although the spillover level remains high. The interaction behind the reflector, where $\Theta<45°$, due to residual illumination of and diffraction from the reflector rim can be seen more clearly.

Figure 11:
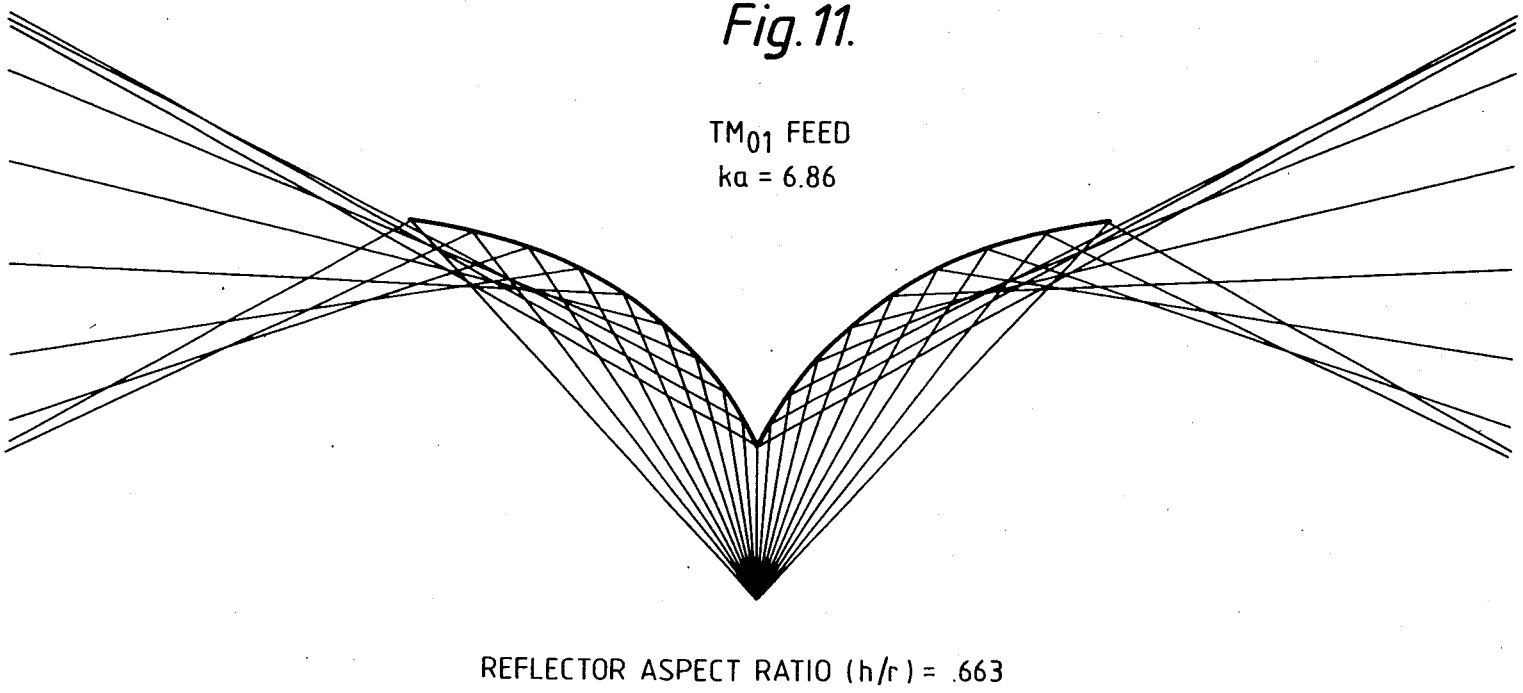
FIG. 11 is a diagrammatic view illustrating a cross section through another reflector shape and the associated ray geometries for a $TM_{01}$ mode feed pattern.

FIG. 11 shows a computer synthesized profile of a reflector and representative ray geometries for a $TM_{01}$ feed. The feed radius a is given by $ka=6.86$ ($k=2\pi/\lambda$). The feed angle ($\Theta^{11}$) subtended at the reflector rim was chosen so that the feed gave $-10$ dB illumination there, giving $\Theta^{11}=42°$ for $ka=6.86$.

To achieve reasonably high reflector aspect ratios, it has been found that ka must be large. For instance, $ka=5.67$, giving $-10$ dB illumination at $\Theta^{11}=53°$, results in a reflector aspect ratio of only 0.514, while the corresponding values for $ka=14.708$ are 18° and 0.988. Thus at first sight it would appear advantageous to make ka as large as possible. It should be noted, however, that although the spillover is always 10 dB down on the peak feed level, the far-field signal strength is independent of the feed particular being always about 3 dB up on the isotropic feed level. Thus as ka increases, the feed gets more directive. Hence the spillover level with respect to isotropic also increases, so that as ka increases the spillover level begins to approach the far-field signal level, causing adverse interaction with it.

Figure 12:
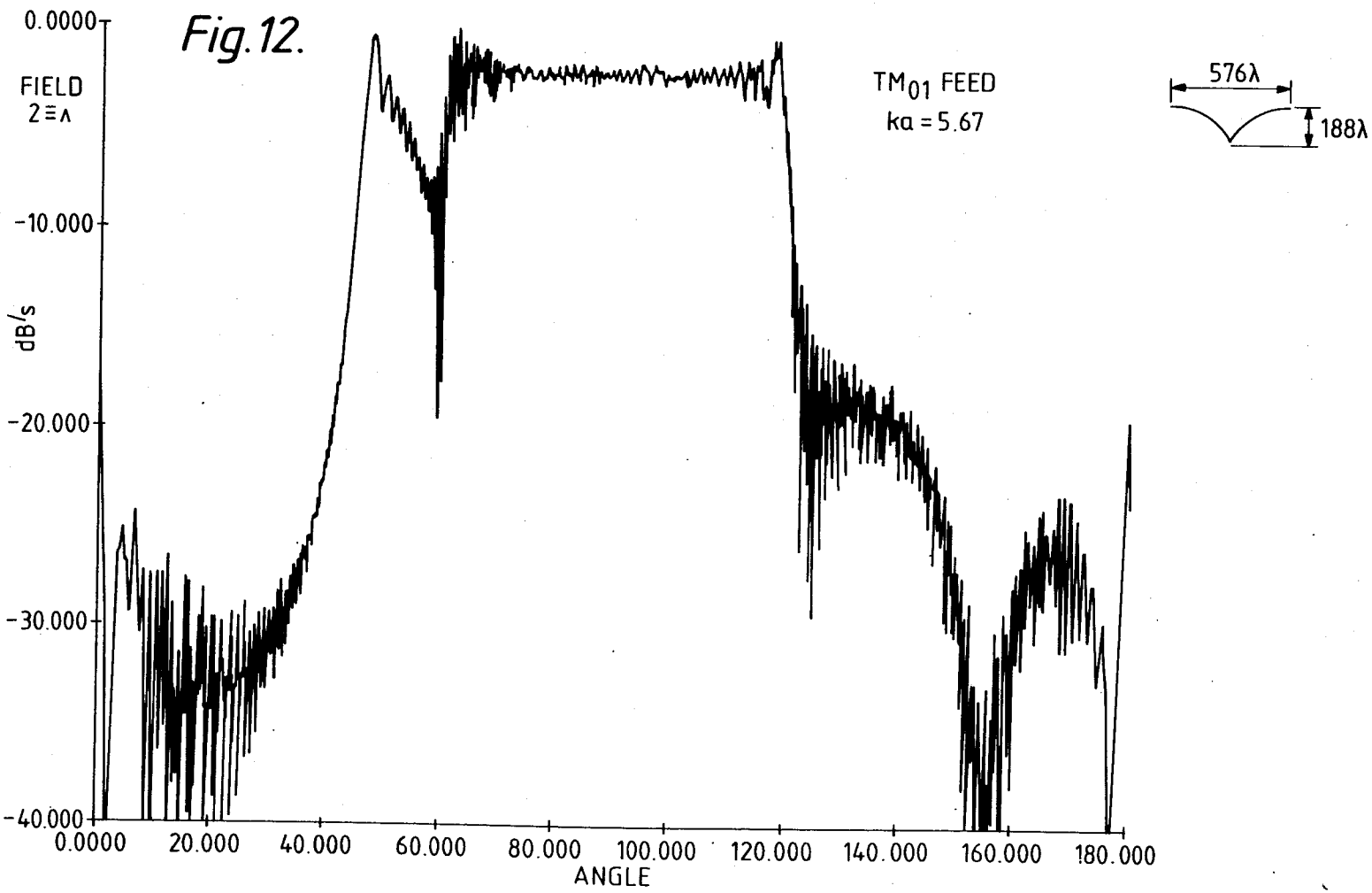
FIG. 12 is a graph illustrating the far-field pattern as given by physical optics for an antenna height $h=188\lambda$.

A physical optics analysis of the far-field pattern for this system is shown in FIG. 12. This is for $ka=5.67$ and an antenna height of $188\lambda$. This was specified to enable the spillover and rim diffraction components to be studied in some detail. It can be seen that the peak spillover at $\Theta^{11}=45°$ is within a dB or so of the sectoral far-field signal level, and the peak rim diffraction, in turn, marginally exceeds it.

Figure 13:
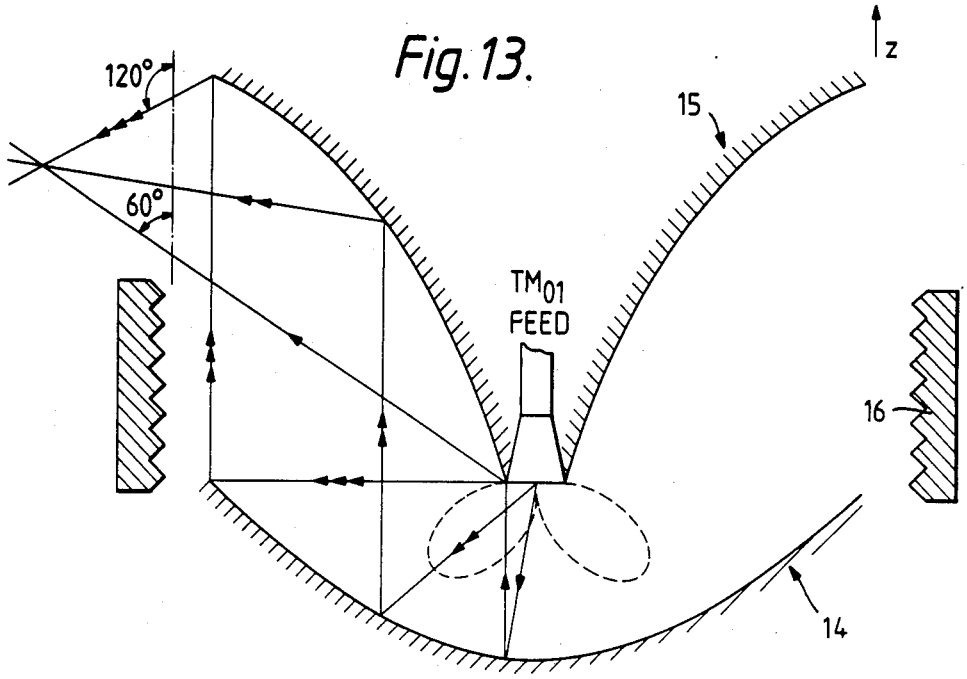
FIG. 13 is a sectional view of a basic dual reflector construction of an azimuthally omnidirectional antenna with sectoral elevation.

It was considered that better control of spillover levels might be achieved with a dual-reflector design. While this involves some increase in system complexity, feeds with small apertures could be employed to control the spillover levels. Simultaneously higher (main) reflector aspect ratios could be achieved. Such a dual reflector system is illustrated in FIG. 13. A parabolic sub-reflector 14 is placed so that its focus coincides with the feed phase center. The function of sub-reflector 14 is to collimate the broad beam from the small aperture feed into a pencil beam comprising a bundle of parallel rays in the near field of the sub-reflector. The edges of the sub-reflector are made to correspond to the $-10$ dB levels of the feed field. This value corresponds to a reasonable compromise between minimizing diffraction effects from the reflector edges while maintaining aperture efficiency. The collimating action of the sub-reflector permits a main-reflector 15 in its near-field having a higher, more reasonable aspect ratio. The main reflector 15 has a reflecting surface comprised by the radially outer surface of an element which tapers generally in the direction of the Z axis and includes an aperture at the smaller radius end thereof. The taper is directed towards the sub-reflector.

Around the rim of the sub-reflector 14 is provided a substantially cylindrical wall of RAM (radiowave absorbant material) 16 to obstruct and further reduce unwanted spillover radiating directly from the feed into the far-field pattern, without interfering with the desired illumination of the main reflector 15. The feed, indicated as $TM_{01}$, is disposed within the reflector element so that microwave energy can be directed from the aperture in the reflector 15. $TM_{01}$ was again selected primarily on the basis of its constancy of radiation polarization in azimuth. However, an additional advantage is the null on the boresight which leads to a very low back illumination of the feed by reflection form the center region of the sub-reflector 14. This is indicated in FIG. 13.

Figure 14:
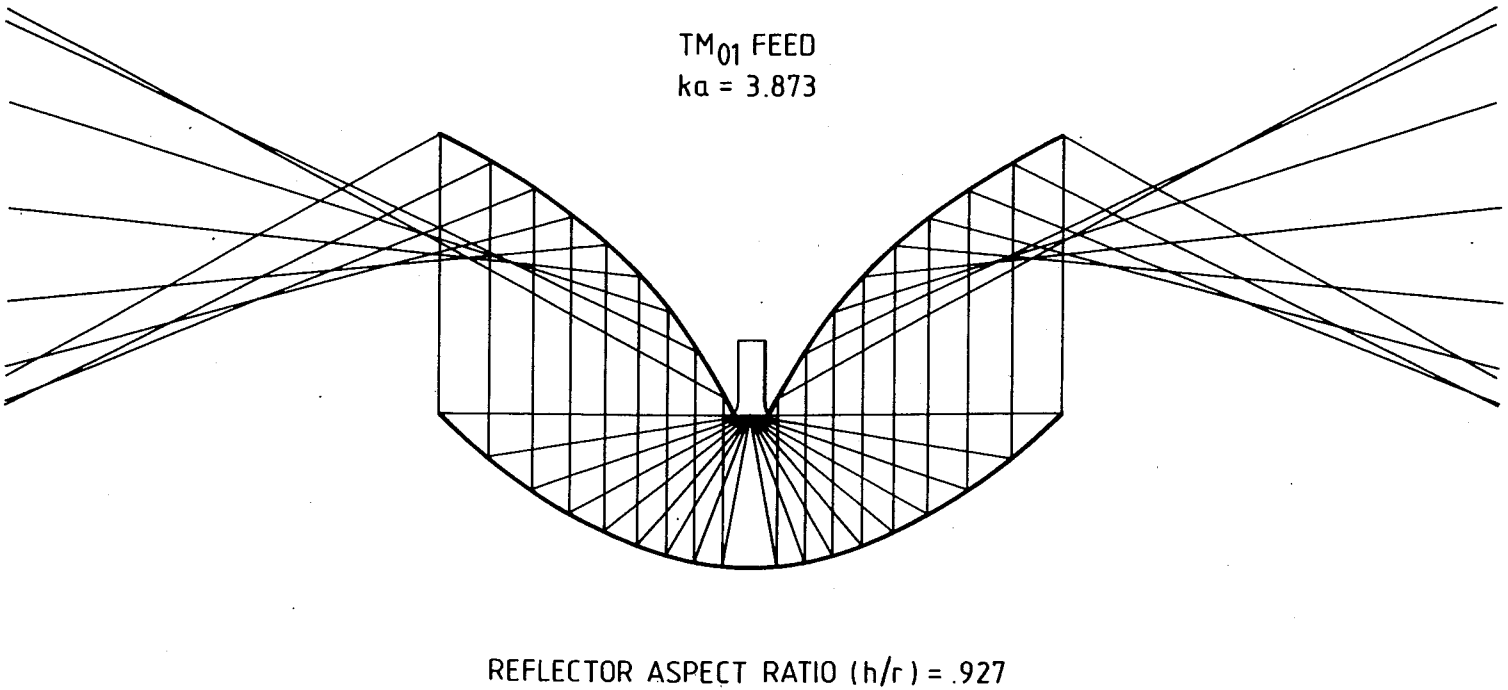
FIG. 14 is a diagrammatic view illustrating a cross section through the two reflectors of a dual reflector construction and the associated ray geometries for a $TM_{01}$ mode circular waveguide feed.

The geometric optics synthesis for the dual reflector arrangement of FIG. 13 is illustrated in FIG. 14 for $ka=3.873$. The main reflector is $10\lambda$ high. The main reflector aspect ratio $(h/r)=0.927$, thus providing a neat compact arrangement. The RAM wall reduced the peak spillover level to 10 dB below the far-field sectoral level. In order to avoid excessive diffraction effects the RAM wall extended to within $2\lambda$ of the bottom far-field ray ($\Theta=120°$).

With the use of a RAM wall the spillover-level can be further reduced by increasing ka. For example, with a RAM wall and $ka=5.67$, the spillover level is 17 dB below the far-field sectoral level. By contrast, without the RAM wall the spillover level rises with respect to the far-field level with increasing ka as in the single reflector case. Values range from $-7$ dB for $ka=3.873$ to 0 dB for $ka=8.6$.

As ka increases the main reflector aspect ratio (h/r) increases only slightly. However, the distance between the main reflector and the sub-reflector starts to increase appreciably, so that the total system becomes less compact, and therefore less attractive for excessively large values of ka.

Figure 15:
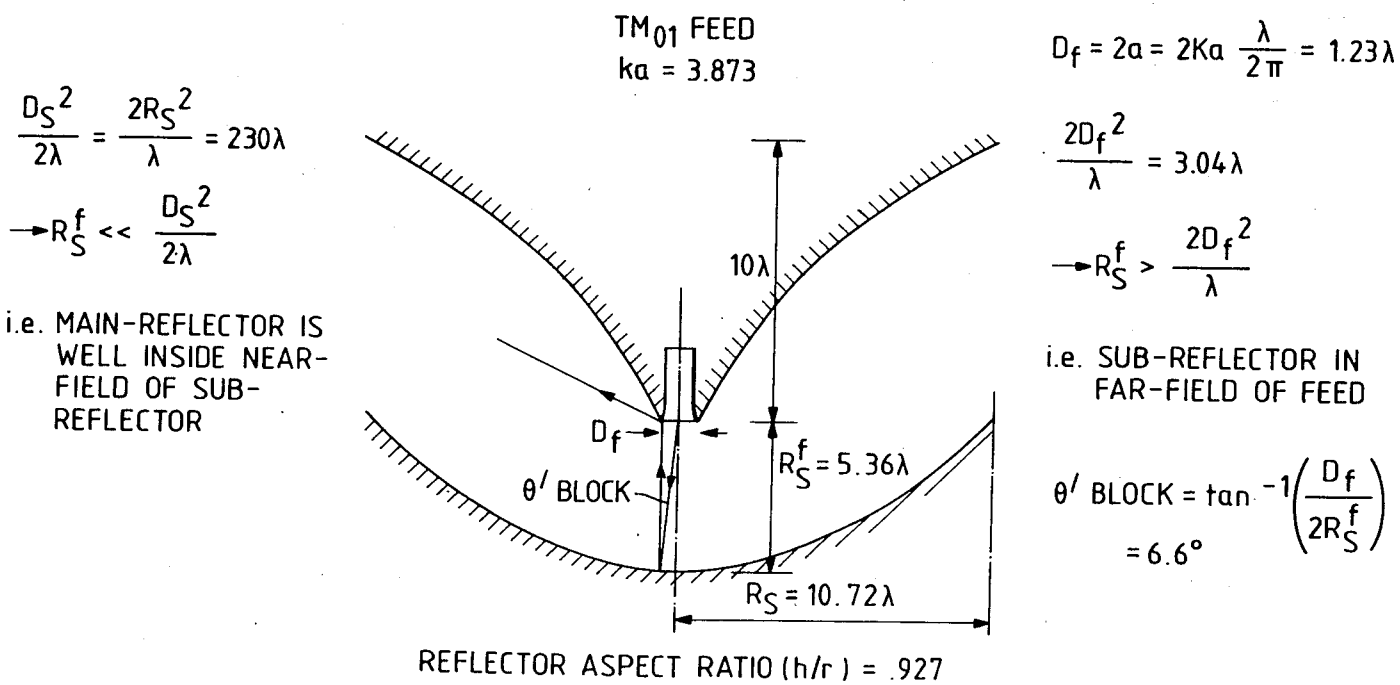
FIG. 15 is a cross sectional view illustrating the far-field near-field criteria computed for the dual reflector construction of FIG. 14, together with a $\Theta^1_{block}$ calculation.

Values of far-field/near-field criteria for the example of $ka=3.873$ are shown computed in FIG. 15, the RAM wall being omitted therefrom. Also shown is the half angle which the feed subtends at the sub-reflector ($\Theta^1_{block}$). Now, $a=D_f/2$ ($D_f$ is the diameter of the feed) and $k=2\pi/\lambda$. Thus $ka=D\pi/\lambda$. For $ka=3.873$, $D_f=1.23\lambda$. $\Theta^1_{block}=\tan^{-1}](D_f/2)/R_s^f]$ where $R_s^f$ is the distance from the feed to the sub-reflector.

To ensure that the feed is in the far-field of the sub-reflector requires $R_s^f \geqq 2D_f^2/\pi=3.04\lambda$. Since $R_s^f$ is in fact $5.36\lambda$, this criterion is satisfied and $\Theta^1_{block}=\tan^{-1}[1.23\lambda/2/5.36\lambda]=6.6°.\Theta^1_{block}$ as calculated compares very well with the $-10$ dB point of the $TM_{01}$ feed null (6.40° for $ka=3.573$) and demonstrates the value of this boresight null in reducing back illumination of the feed by the center of the sub-reflector to relative insignificance. It might be thought that as ka increases, the half-angle subtended by the feed at the sub-reflector would increase in opposition to a decrease on the $-10$ dB point on the null thereby increasing the back illumination problem. In fact, because the main-reflector/sub-reflector distance increases also with increasing ka, both angles decrease and the trends do not conspire to work in opposition.

Thus, although the choice of ka is less clear-cut than in the single reflector case, for the dual-reflector the more compact solution resulting from a small ka, such as $ka=3.873$, is generally preferable.

Figure 16:
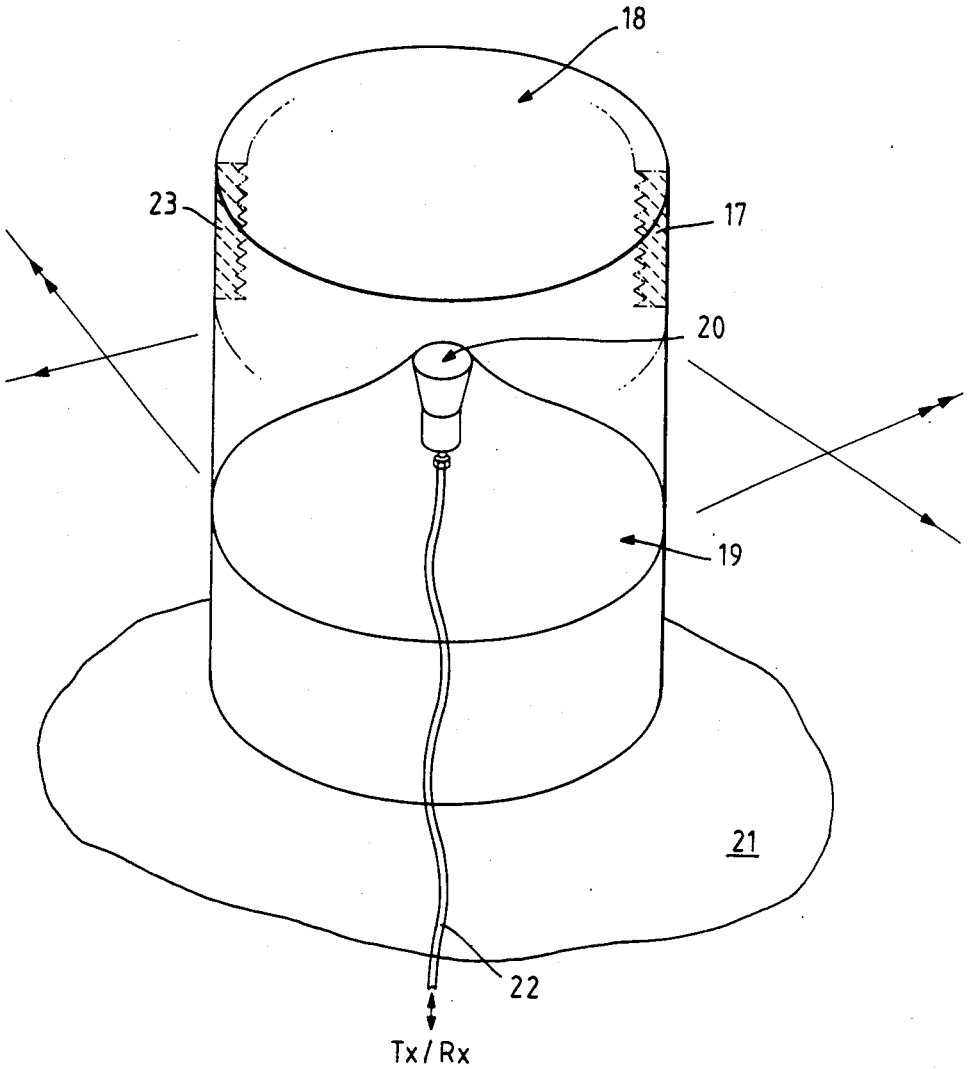
FIG. 16 is a perspective view illustrating a practical dual reflector construction.

FIG. 16 illustrates, schematically, a practical construction of the dual reflector system for a ground/ship platform. It is basically an upturned version of that already described. For mounting under a helicopter platform the original orientation would be preferable. The construction in FIG. 16 comprises a cylindrical radome 17 which is closed at the uppermost end by a parabolic sub-reflector 18. Inside the cylindrical radome is mounted a primary (main) reflector 19. The feed aperture of a $TM_{01}$ feed 20 is disposed at the tip of the reflector 19. The cylindrical radome 17 is mounted at its lower end to the outer skin of a platform 21. A waveguide transmit/receive connection 22 extends through the outer skin and the radome to the $TM_{01}$ feed 20. The orientations proposed both facilitate connections to and from the feed through the platform outer skin without blockage due to waveguide runs etc. The structure which supports the reflector elements, that is the cylindrical radome, extends from the platform outer skin by an amount sufficient to prevent obscuration/-multipath in the immediate vicinity of the platform. The radome cylinder is partially lined with radio absorbant material 23 to reduce spillover as described above. Both of the reflectors 18 and 19, and possibly the $TM_{01}$ feed, may be fabricated from metallized plastics material, enabling them to be both very accurately and cheaply mass-produced. The whole structure constitutes an inherently relatively low drag configuration.

Figure 17A:
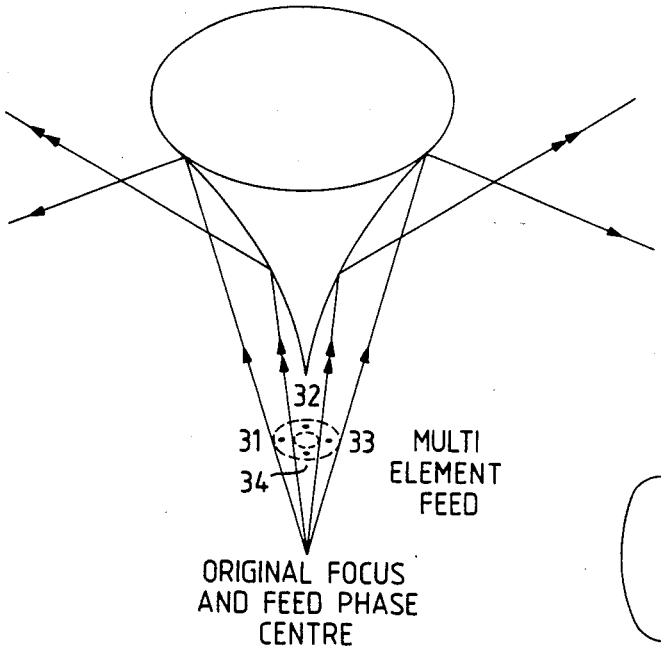
FIGS. 17*a* and 17*b* are diagrammatic views showing respectively a multi-element feed and the associated azimuthal patterns of the individual elements.

The reflector arrangements so far described place the feed at the reflector/reflector combination azimuth and elevation focus so that, on transmission, power is radiated equally in all azimuths and in the desired sector in elevation. However, if the feed position is displaced slightly upwards or downwards from the original focus, a single feed can be replaced by a multiplicity of feeds arranged in a ring as indicated in FIG. 17*a* for a simple single reflector design. The major features of the sectoral elevation pattern will be maintained relatively undistrubed, while the azimuth patterns will be changed from omnidirectional to distinctly directional.

Figure 17B:
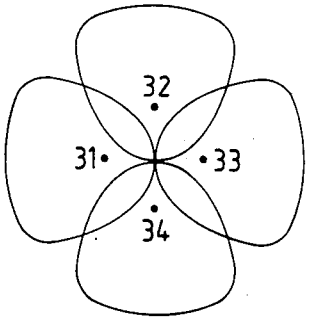

Considering the system in the transmit mode it can be seen (FIG. 17*b*) that for a ring of feed elements 31–34 having a relatively large ring diameter, the radiation in certain azimuthal sectors is likely to become largely controlled by the excitation of particular elements in the ring. Therefore this antenna system on receive can be employed as a direction finding device by using simple interelement response conparison or monopulse type processing on overlapping azimuthal beam patterns to determine the azimuthal angle of incident radiation. Full azimuthal direction finding of incident radiation can thus be achieved.

Alternatively, for a small diameter ring of feed elements where the resulting azimuthal far-field patterns associated with each individual element are likely to be identical, the small number of feed elements likely to be involved suggests the use of an adaptive signal processor based on the circular array concept. The reflector assembly here could then be regarded purely as a system for increasing the elevation directivity of the individual feed elements constituting the circular array. Such a system would provide simultaneous multiple signal direction finding and/or constitute a jam-resistant communication receiver system.

What is claimed is:

1. An antenna system for radiating electromagnetic energy omnidirectionally in azimuth and sectorally in elevation comprising:

a first reflector, said first reflector being parabolic in shape;

a second reflector, said second reflector being tapered symmetrically about a first axis and said second reflector having an aperture at the tapered end thereof; and electromagnetic feed means disposed within said second reflector to radiate energy through said aperture in the direction of said first reflector, said first reflector and said second reflector being relatively disposed such that energy radiated from said feed means irradiates said first reflector and is reflected thereby onto said second reflector and is reflected from said second reflector omnidirectionally in azimuth and sectorally in elevation.

2. The antenna system of claim 1 wherein said first reflector is disposed with its focus coincident with a phase center of said feed means.

3. The antenna system of claim 1 including a substantially cylindrical wall of absorbent material disposed around the rim of said first reflector.

* * * * *